United States Patent [19]

Memmott

[11] 4,193,615

[45] Mar. 18, 1980

[54] ROD SELECTOR GUIDE

[75] Inventor: Sharon S. Memmott, Cincinnati, Ohio

[73] Assignee: Zotos International, Inc., Darien, Conn.

[21] Appl. No.: 910,284

[22] Filed: May 30, 1978

[51] Int. Cl.[2] ..... B42D 15/00

[52] U.S. Cl. ..... 283/1 A

[58] Field of Search ..... 283/1 R, 1 A, 7, 36

[56] References Cited

U.S. PATENT DOCUMENTS

| | | | |
|---|---|---|---|
| 1,387,261 | 8/1921 | Harmuth | 283/1 A |
| 1,525,754 | 2/1925 | Le Page | 283/1 A |
| 3,350,805 | 11/1967 | Jorgensen | 283/1 R X |

*Primary Examiner*—Robert L. Spicer, Jr.

*Attorney, Agent, or Firm*—Mattern, Ware, Davis & Stoltz

[57] ABSTRACT

By categorizing alternative hair textures and curl configurations in a display having various hair length and corresponding rod diameters displayed therewith, a compact, easily employable rod sector guide is achieved. In the preferred embodiment, the rod selector guide comprises a hand holdable instrument and is in the form of an elongated, substantially flat member with the information displayed on both sides thereof in an easily readable, readily identifiable chart format. Furthermore, the rods are preferably color coded by diameter, and the rod selector guide employs the specific color of each rod which is preferred for each combination of factors.

12 Claims, 2 Drawing Figures

ROD SELECTOR GUIDE

BACKGROUND OF THE INVENTION

My invention relates to the selection of curling rods for use in the permanent waving of hair and, more particularly, to an instrument which will aid the hairdresser in achieving a more precise and rapid rod selection and better permanent waving.

Heretofore, the hairdresser has received instructions for permanent waving while a student in school. However, directions she has followed may have to be modified when she becomes employed by a beauty shop which uses a different permanent waving product from the one used by the school. Also, manufacturers are continually marketing new products with new processes. With some permanent waving products the methods may vary so widely that instruction manuals and/or wall charts with illustrations have to be supplied. Constant reference to these during the permanent waving is tedium, time-consuming, and destructive to good customer relationships.

In all instructions, one of the most important steps, and one which is common to all permanent waving methods, is the selection of the curling rods to be used on the head. Rod selection for the various sections of hair on the head is the key to obtaining the permanent curling of each wound hair strand so that the finished permanent waved hair on the entire head may be styled into the coiffure desired by the customer, and agreed to by the hairdresser in consultation with the customer, prior to the start of the wave. The hair on the head is cut to conform to this desired coiffure. This is always done prior to the waving. Some hairdressers may prefer to give a finishing "trim" after the permanent wave but hair on the various sections of the head must be at least "rough-cut" to the approximate lengths desired in the finished coiffure. The various sections of the head are divided into the "front", "crown," "temple," and "nape" areas but these may be subdivided in the descriptive terms "left" and "right" and "upper" and "lower."

In the selection of rods, the hairdresser must know these exact lengths of the hair in the various sections of the hair, after the hair is "cut" or "rough-cut." While these simple measurements may be made with a ruler, they must be immediately integrated with several other factors in order to select the proper rod upon which to wind the measured hair. These factors are the diameter of the hair, better known by the hairdresser as the "texture" of the hair and the desired "configuration" of the permanently formed curl. "Texture" of hair will vary from "Medium to Coarse" and from "Medium to Fine." Configuration of the curl may vary from a "soft curl" or "wavy" to a "medium curl" or "curly" to an extremely "tight curl" or "very curly."

Thus, there are quite a few variables that must be integrated in order to select the proper size rod and since the number of rods may be as many as seven in number, and whose diameters will vary from a very small diameter to a diameter three or four times greater, the hairdresser can easily make a mistake in the selection of the right rod.

Therefore, it is a principal object of this invention to provide a rod selector guide which incorporates all of the alternative factors required to select a rod size and provides quickly identifiable display of the optimum rod size for any combination of factors.

Another object of this invention is to provide a rod selector guide having the characteristic features defined above which is adaptable to all permanent waving situations.

Another object of the present invention is to provide a rod selector guide having the characteristic features defined above wherein the guide is easily held in the hand of the hairdresser for quick and easy reference.

A further object of the present invention is to provide a rod selector guide having the characteristic features defined above which is also capable of measuring the length of the hair.

Other and more specific objects will in part be obvious and will in part appear hereinafter.

SUMMARY OF THE INVENTION

My invention eliminates the prior art problems by achieving a rod selector guide which incorporates all of the alternative information a hairdresser requires for selecting the optimum rod size and provides this compact reference information on a single hand-holdable instrument. In the preferred embodiment, the rod selection guide of the present invention also incorporates means for measuring the length of the hair, in order to further assist the hairdresser in assembling all of the variable information in order to obtain the optimum rod size selection. In this way, the instrument of the present invention can measure the length of the hair and yet it is so small in size it will easily fit into the pocket of the hairdresser.

As discussed above, the hairdresser must base the decision of the rod size on (1) the hair length, (2) the hair texture, and (3) the curl configuration desired. The rod selector guide of the present invention incorporates all of the potential variables of these factors in a coordinated arrangement with the optimum rod size prominently displayed for each combination of factors.

Although other systems are clearly within the scope of this invention, I have found that the most advantageous method is to employ color coded rods, with each color representing a specific rod size. In this way, my rod selector guide specifies the color of the rods which are the best certain combinations of factors, and the hairdresser is able to quickly and efficiently determine the rod size by using only the rod color and my guide.

In the preferred embodiment, my rod selector guide is a flat, rectangular card, twelve inches long and two and one-quarter inches in width. It may be made of metal, paper or plastic, but should be sufficiently thick to give it a rigid structure. Since each side contains a reference chart, the instrument should be coated with a hard, clear polymer finish to protect it and yet allow it to be hygienically cleaned between use.

As would be obvious to one skilled in the art, my rod selector guide can be manufactured in various configurations without departing from the scope of my invention. In particular, the rod selector guide could have any dimensional configuration and could incorporate rotating display information whereby the variable factors could be selected by rotating cooperating members. Since these variable constructions are equally useful, all such constructions are within the scope of my invention. However, for exemplary purposes only, I will concentrate on my preferred construction throughout the remainder of this specification, but this disclosure should not be interpreted as limiting the scope of my invention.

The invention accordingly comprises an article of manufacture possessing the features, properties, and relation of elements which will be exemplified in the article hereinafter described, and the scope of the invention will be indicated in the Claims.

THE DRAWINGS

For a fuller understanding of the nature and objects of the invention, reference should be had to the following detailed description taken in connection with the accompanying drawings in which:

FIG. 1 is a front elevation view of the preferred embodiment of the rod selector guide of the present invention; and FIG. 2 is a rear elevation view of the rod selector guide of the present invention.

DETAILED DESCRIPTION

Figure 1:
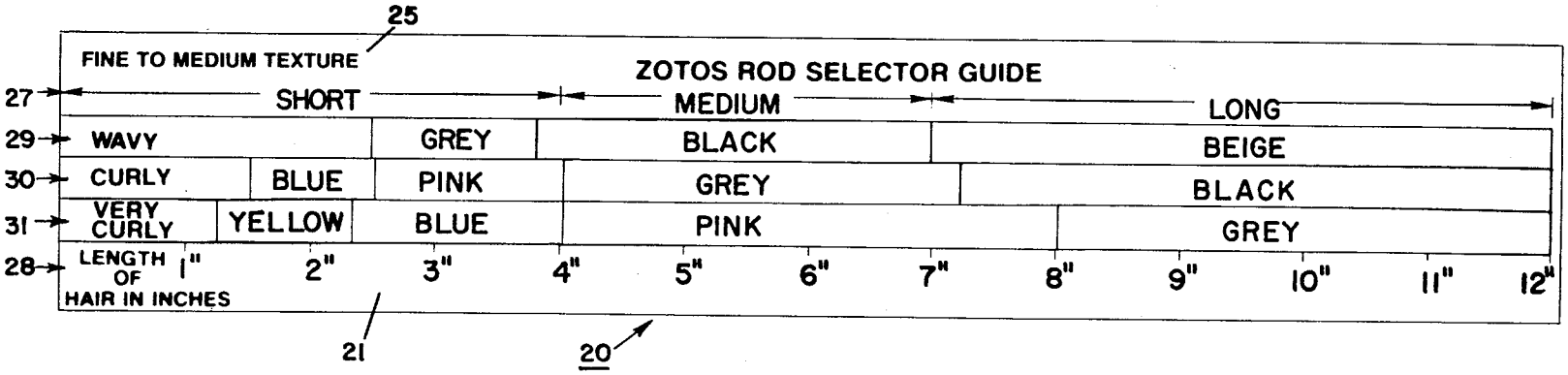
Figure 2:
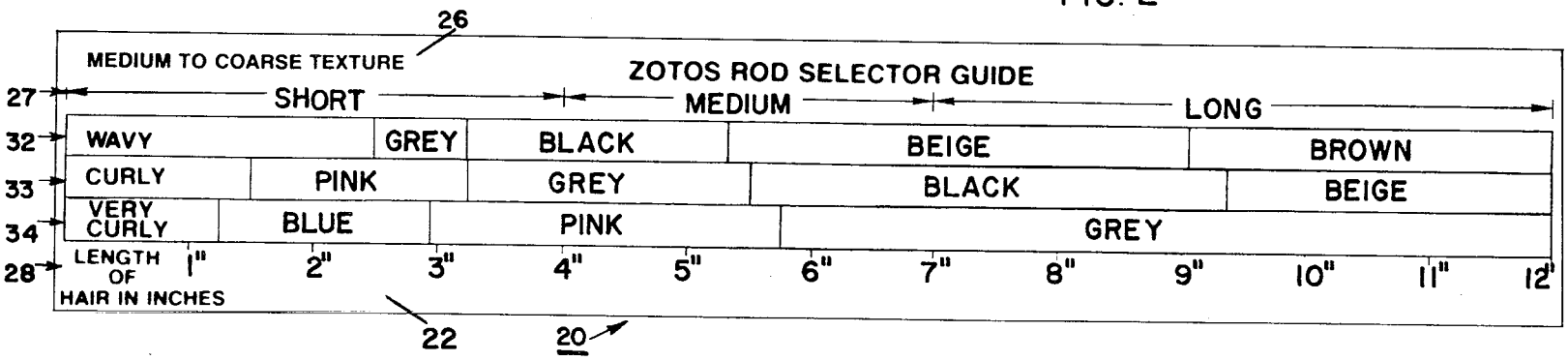

In FIGS. 1 and 2, the preferred embodiment of the rod selector guide of the present invention is shown. In this embodiment, rod selector guide 20 comprises an elongated substantially flat member having a width of sufficient dimension to allow the information to be contained thereon in easy readable form. Furthermore, rod selector guide 20 comprises a front surface 21 and a rear surface 22 both of which contain information display.

Using the teaching of the present invention, the rod size selection information may be displayed in a variety of alternative arrangements. For ease of construction and ease of readability, the display system shown in FIGS. 1 and 2 is preferred.

As discussed above, the three principal factors employed by the hairdresser in determining the optimum rod size to use in a particular situation are (1) the hair length in the area to be curled, (2) the hair diameter or texture, and (3) the hair configuration of curl configuration desired. As shown in FIGS. 1 and 2, the hair diameter or texture is prominently displayed along the top of rod selector guide 20. Line 25 on front surface 21 of rod 20 clearly displays that all of the information contained thereon applies to "Fine to Medium" textured hair. Similarly, top line 26 of rear surface 22 of rod selector guide 20 clearly shows that the information contained on rear surface 22 applies to hair having a "Medium to Coarse" texture. These two designations, namely, "Fine to Medium" or "Medium to Coarse" are the only two principal designations for hair texture. It is believed that these two designations are sufficient for any situation in which the rod selector guide will be employed. However, if greater definition is required in other specific instances, certainly, such designations are within the scope of my invention.

The second factor which the hairdresser must consider in determining the rod size to employ is the length of the hair in the particular area to be curled. For hair length, my rod selector guide preferably employs two alternative designations. The first designation is found along horizontal line 27 wherein the hair length has been designated as either "short," "medium" or "long". Since these designations provide a general, overall designation for hair length, the preferred embodiment of my rod selector guide also incorporates the specific designation of hair length in inches, represented in FIGS. 1 and 2 by line 28.

In the preferred embodiment, line 28 is to scale, thereby allowing the rod selector guide of my invention to be used as a ruler in which the actual hair length can be measured directly with rod selector guide 20 with the rod sizes quickly and easily being determined therefrom. Although rod selector guide 20 can incorporate any desired length with the inches marked thereon to scale, I have found that a typical twelve inch ruler length is extremely easy to use as well as convenient for the hairdresser to employ.

The last factor which the hairdresser must employ in order to determine the optimum rod size is the hair configuration or curl configuration desired. This factor is displayed and incorporated into rod selector guide 20 along horizontal lines 29, 30 and 31 on front surface 21 and along horizontal lines 32, 33, and 34 on rear surface 22.

Preferably, the curl configuration information is employed by using specific headings designating the type of curl desired. Consequently, line 29 or line 32 would be used by the hairdresser when a "soft curl" or "wavy" is desired, line 30 or 33 is used when a "medium curl" or "curly" is to be achieved, and horizontal line 31 or 34 is employed when a "tight curl" or "very curly" is sought.

As shown in FIGS. 1 and 2, lines 29, 30, 31, 32. 33, and 34 incorporate specific rod color designations forming the remainder of each horizontal line. As discussed above, the designated colors refer to specific rod sizes all of which are color coded for convenience and ease of use and handling. The specific color designation and the specific length over which a particular color extends horizontally along a particular line is vertically aligned with the length of the hair for which the particular designated rod is the optimum rod to employ in that given situation. Consequently, by combining horizontally displayed information in a vertically cooperating arrangement, the optimum rod size, designated by colors, is quickly and easily identifiable for any combination of factors with which the hairdresser may be required to handle.

In particular, I have found that line 29 of front surface 21 of my rod selector guide preferably designates rod colors grey, black and beige with the lengths shown and designated in FIG. 1. Line 30 designates blue, pink, grey and black, while line 31 designates rod color yellow, blue, pink and grey. Line 32 of rear surface 22 of my rod selector guide 20 designates rod colors grey, black, beige and brown, while line 33 designates rod colors pink, grey, black and beige, and line 34 designates rod colors blue, pink and grey.

As mentioned above, each of these color designations occupies a horizontal width which cooperates with the hair length designations along line 28. In this way, the hair length and the hair configuration or curl configuration desired are automatically coordinated in order to provide a specific easily readable display of the optimum rod to employ for given conditions.

In addition to the descriptive colors these areas will preferably be colored so as to match the colors of the rods for easy identification. In other words, the smallest diameter (0.19 inches) is a yellow rod and is referred to in the chart by the word "YELLOW." The next smallest diameter rod (0.28" ) is a blue rod and is referred to on the chart as "BLUE." Next in increasing rod diameter (0.34" ) is the pink rod, the chart reference being "PINK;" the "GREY" area is for grey colored rods with a diameter of 0.46 inches; the "BLACK" area is for the black colored rod with the diameter of 0.54 inches; the "BEIGE" area is for the beige colored rod with the diameter 0.57"; the "BROWN" area is for the brown colored rods with the diameter 0.63".

The spacing of the rectangular areas in which these words of color are to be found are most important. The lengths have a direct relationship to the lengths of hair on the lower line and to the desired "configuration" listed at the beginning of the horizontal line on which the respective "colored" areas are found.

Thus in use, having determined the "Texture" of the hair, when the hairdresser starts on a section of hair on the head, needs only my instrument to guide her to select the proper rod on which to wind that particular strand of hair. If a wide wave or soft curl (termed on the chart as "Wavy") is desired, and knowing that the hair is "Fine to Medium Texture," she measures the length of hair, if it is roughly 4" or less, the chart shows that the hairdresser will select and use the "grey" colored rods; if the length is 4" to 7" the proper rod selection is the "black" colored rod; if the length is greater than 7" then the proper selection is the beige colored rod. If a medium tightness wave or curl (termed on the chart as "Curly") is desired on the "Fine to Medium Texture" hair, and the length of the hair is 2½" or less, the blue colored rods are used; if between 2½" and 4" the pink colored rods are used; if between 4" and 7¼" the grey colored rods are used; of greater than 7¼" the black colored rods are used. If a very tight wave or curl, (termed on the chart as "Very Curly") on Fine to Medium Texture hair is desired and the hair length is less than 2¼" the yellow rods are used, if the hair length is roughly 2¼" to 4", the blue colored rods are used, if between 4" and 8" the pink colored rods are used, and greater than 8" the grey colored rods are used.

On the other hand, if the hair is determined by the hairdresser to be "Medium to Coarse Texture," the side so labeled is used both as for measuring the hair length and for the reference chart to guide in rod selection. For example, if a "WAVY" configuration is desired and the hair length measures approximately 3¼" or less, the chart shows that the grey colored rod is the proper selection and should be used; if the hair length is greater than 3¼" but less than 5½" the black colored rods are selected; if the hair length is greater than 5½" but less than 9", the beige colored rods should be selected; if the hair length is greater than 9" the brown colored rod should be selected. If a "CURL" configuration is desired and the hair length measures less than 3¼" the chart shows that the pink colored rods should be selected, if the length of hair is greater than 3¼" but less than 5½", the grey colored rods are selected; if the hair length is greater than 5½" but less than 9½" the black colored rods are selected; if the length of hair is greater than 9½" the beige colored are selected. If a "VERY CURLY" configuration is desired, and the hair length measures less than 3" the chart shows that the blue colored rods are to be selected and used; if the hair length is greater than 3" but less than 5¾" then the pink colored rods are selected; if the hair length is greater than 5¾" then the grey colored rods are used.

My instrument may be used with any system of permanent waving process now in commerical practice that uses rods upon which to wind the hair so as to conform the hair to a desired configuration while a chemical solution is reacting with the chemical groups within the hair to allow for a molecular flow and adjustment to occur within the hair fibers' structure which is then made permanent by rinsing the hair with water and then treating the hair with a second solution containing chemicals which will restore the hair to its original chemical form but permanently locked in the physical structure of the new configuration due to the hair being wound about the rod. This normalizing, or neutralizing solution is usually rinsed out with water.

It will thus be seen that the objects set forth above, among those made apparent from the preceding description, are efficiently attained and, since certain changes may be made in the above article without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

I claim:

1. A rod selector guide for assisting hairdresser to select an optimum rod diameter for use in permanent hair waving, the rod selector guide comprising a handholdable instrument incorporating an information display having A. first indicia representing alternative hair textures;

B. second indicia representing alternative curl configurations;

C. third indicia a. representing various hair lengths, and b. cooperatively associated with the second indicia in the information display; and D. fourth indicia a. representing alternative rod diameters, and b. positioned in the information display in cooperative association with the second and third indicia, whereby the optimum rod diameter for any curl configuration at any hair length is readily determinable.

2. A rod selector guide defined in claim 1, wherein the second indicia provide alternative, selectable headings in the information display and the third indicia are positioned in cooperative association with the second indicia in the information display to provide a rod diameter information retrieval zone wherein any rod diameter is quickly and easily obtained by referring to the combination of factors displayed in the information display.

3. The rod selector guide defined in claim 1, wherein said rod selector guide comprises a substantially flat, elongated member having a front and rear surface upon which alternative information displays are mounted.

4. The rod selector guide defined in claim 3, wherein said information display comprises a printed chart on said elongated flat member with the third indicia forming a horizontal axis of the chart and the second indicia form a vertical axis of the chart.

5. The rod selector guide defined in claim 4, wherein alternative rod diameters are prominently displayed in discreet, readily identifiable segments along the length of guide, corresponding directly to the minimum and maximum hair lengths for which a particular rod diameter is preferred for a particular curl configuration.

6. The rod selector guide defined in claim 3, wherein said third indicia is further defined as comprising linear measurements designations with said designation being to scale, thereby providing a rod selector guide capable of being employed as a ruler in which the actual hair length can be measured therewith.

7. The rod selector guide defined in claim 6, wherein said elongated member is further defined as comprising linear measurement designations in inches, an overall length to twelve inches, and a width of between about two and five inches, thereby providing sufficient area for the information display in an easily readable form while also being conveniently sized for comfortable holdability and storability.

8. A rod selector guide for assisting hairdressers to select the optimum rod diameter for use in permanent hair waving, wherein each rod is color-coded by diameter, the rod selector guide comprising a hand-holdable instrument providing an information display comprising A. first indicia representing alternative hair textures;

B. second indicia a. representing alternative curl configurations, and b. forming alternative selectable headings as the vertical axis of the information display;

C. third indicia a. representing various hair lengths, and b. positioned in cooperative association with the second indicia as the horizontal axis of the information display, establishing a rod diameter information retrieval zone in the information display; and D. fourth color-identifying indicia a. corresponding to the color-coded rods, b. positioned in the rod diameter information retrieval zone of the display, and c. comprising a plurality of discreet segments, each of the segments corresponding to the minimum and maximum hair lengths for which a particular rod diameter is preferred for the particular curl configuration, whereby the optimum diameter rod for a particular combination of conditions is quickly and easily identified by the color corresponding to the optimum rod diameter.

9. The rod selector guide defined in claim 8, wherein said fourth indicia comprises alphabetic indicia corresponding to the rod color.

10. The rod selector guide defined in claim 8, wherein said third indicia comprises various specific linear measurement designations with each of said designations being to scale.

11. The rod selector guide defined in claim 10, wherein said third indicia forms a measuring tool whereby the length of the hair can be measured directly with the rod selector guide.

12. The rod selector guide defined in claim 8, wherein the guide is manufactured from one selected from the group consisting of metal, plastic, and cardboard.

* * * * *